US005722662A

United States Patent [19]

Howell

[11] Patent Number: 5,722,662

[45] Date of Patent: Mar. 3, 1998

[54] HAND HELD AMUSEMENT DEVICE

[76] Inventor: Byron H. Howell, 3145 Market, East St. Louis, Ill. 62207

[21] Appl. No.: 695,338

[22] Filed: Aug. 9, 1996

[51] Int. Cl.[6] ..... A63B 67/10

[52] U.S. Cl. ..... 273/329

[58] Field of Search ..... 273/319, 320, 273/321, 329, 330, 331, 332, 333, 334, 335, 413, 414

[56] References Cited

U.S. PATENT DOCUMENTS

| | | | |
|---|---|---|---|
| 576,891 | 2/1897 | Reiff | 273/332 |
| 4,040,623 | 8/1977 | Ott | 273/329 |
| 4,145,051 | 3/1979 | Krumholz | 273/330 |

*Primary Examiner*—William H. Grieb
*Attorney, Agent, or Firm*—Polster, Lieder, Woodruff & Lucchesi

[57] ABSTRACT

A hand held amusement device includes a rigid board having a front surface, a back surface, side edges, a top edge, and a bottom edge. An opening is formed in the board spaced from the top edge and centered between the side edges of the board. A pair of ears extend rearwardly from the side edges of the board at the top thereof. The ears have axially aligned ear holes through which a rod is rotatably journaled. A cord having a fixed end and a free end is mounted to the board to extend from the front surface of the board. The cord has a length less than the distance between the bottom of the opening and the bottom edge of the board. A ball is secured to the free end of the cord and is made of a material, such that the ball will bounce against the board.

11 Claims, 1 Drawing Sheet

HAND HELD AMUSEMENT DEVICE

BACKGROUND OF THE INVENTION

This invention relates to amusement devices, and in particular to hand held games of skill.

Children enjoy games of skill and hand held games which they may use to compete against one another or play by themselves. One such type of game is a hand held game which includes a cup on the end of a shaft. A string is fixed to the shaft and a ball is secured to the free end of the string. The ball is then swung relative to a cup to try and get the ball into a cup. Larger versions and variations of this game may be enjoyed by children of all ages.

SUMMARY OF THE INVENTION

One object of the present invention is to provide a hand held amusement device.

Another object is to provide such a device which includes a ball which the user attempts to pass through a hole in a board.

These and other objects will become apparent to those skilled in the art in light of the following disclosure and accompanying drawings.

In accordance with the invention, generally stated, a hand held amusement device is provided. The amusement device includes a rigid board having a front surface, a back surface, side edges, a top edge, and a bottom edge. An opening is formed in the board spaced from the top edge and centered between the side edges of the board. A pair of ears extend rearwardly from the side edges of the board at the top thereof. The ears have axially aligned ear holes through which a rod is rotatably journaled. The rod is preferably axially fixed relative to the ears. A cord having a fixed end and a free end is mounted to the board to extend from the front surface of the board at a point below the opening and centered between the side edges of the board. The cord has a length less than the distance between the bottom of the opening and the bottom edge of the board. Preferably, a hole is formed beneath the board opening through which the cord is threaded. A knot is then formed at the fixed end of the cord to prevent the cord from being pulled from the board. A ball is secured to the free end of the cord and is made of a material, such that the ball will bounce against the board.

DESCRIPTION OF THE PREFERRED EMBODIMENT

Figure 1:
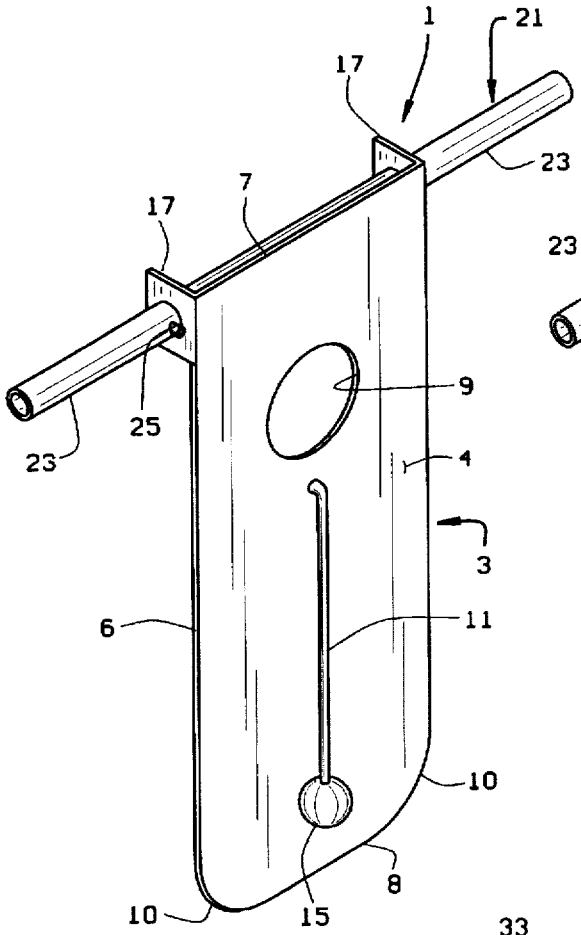
FIG. 1 is a front perspective view of a ball game of the present invention.
Figure 2:
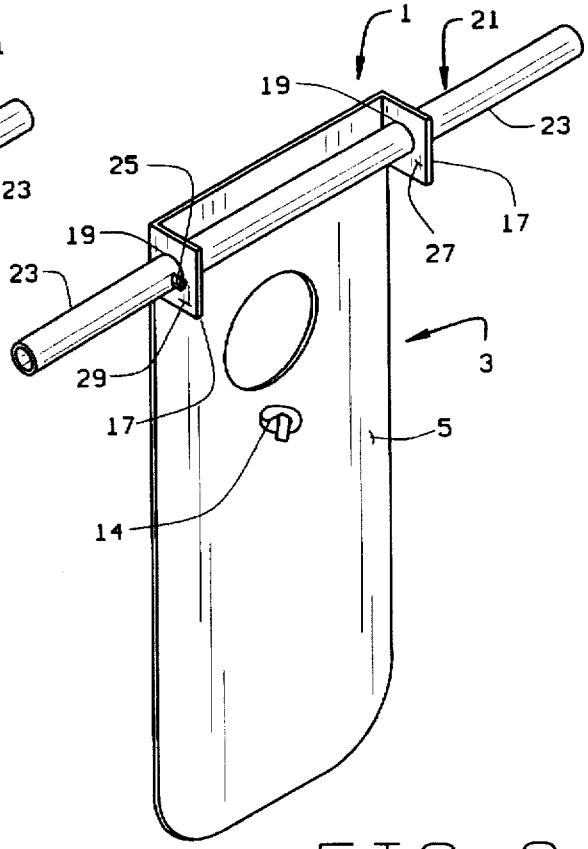
FIG. 2 is a rear perspective view of a ball game.

A ball game 1 of the present invention is shown generally in FIGS. 1 and 2. The ball game 1 includes a stiff rigid board 3 having a front surface 4, a back surface 5, side edges 6, a top edge 7 and a bottom edge 8. The bottom corners 10 of the board are preferably rounded. An opening 9 is formed in the board 3 and a string or cord 11 is mounted to the board 3 just below the opening 9 to extend from the front surface 4 of the board. The opening 9 and cord 11 are both centered between the side edges 6 of the board. Preferably a small hole 13 is formed in the board 3 through which the cord is passed, and a knot 14 is formed at a fixed end of the cord 11 adjacent the back surface 5 of the board. The knot is sized to prevent the cord 11 from being pulled through the board. The cord alternatively can be secured to a pin or the like which will prevent the cord from detaching from the board.

A ball 15 is secured to the free end of the cord 11. The opening 9 is sized and shaped to allow the ball 15 to pass therethrough. The ball 15 and board 3 are preferably made of materials which allow the ball to bounce when it hits the board. Preferably, the board 3 is plastic, illustratively a ⅛" thick, opaque, high-density polyethylene, but it could be made of wood or other materials which may be made sufficiently rigid or stiff. Preferably, the ball 15 is a light weight ball, such as a hollow table tennis ball. However, a rubber or plastic ball, a super ball, or a wooden ball could also be used. The cord 11 has a length less then the distance between the cord hole 13 and the bottom edge 8 of the board. Thus, when the cord 11 is laid along an axis of the board 3, the ball 15 is on the board. In a preferred embodiment, the board 3 is approximately 14"×6", the distance between the cord hole 13 and the bottom edge 8 of the board 3 is about 7½", and the length of the cord 11 is approximately 6". The opening 9 is illustratively 3" in diameter, and the ball 15 is 1.5" in diameter. Other dimensions of course could be used.

A pair of ears 17 extend rearwardly from the side edges 6 at the top thereof. The ears 17 have axially aligned holes 19 formed therein to rotatably receive a rod 21. Rod 21 is preferably hollow. The rod 21 has a length greater than the side-to-side width of the board 3, and thus forms handles 23. The rod 21 is sized such that the board 3 can pivot or swing relative to the rod 21. By way of example, the rod 21 may be 18" long and ¾" ion diameter, illustratively a polyethylene tube having a 0.05" wall thickness. The holes 19 may be 13/16" in diameter. Because the ears 17 tend to return to their flat position, they engage the outside of the rod 21 and tend to prevent axial movement of the rod 21. Means 25 are optionally provided adjacent the inner surfaces 27 or outer surfaces 29 of the ears 17 to prevent the rod from sliding axially relative to the board 3. Such means may include, for example, lock washers which are fitted on the rod 21 or pins which pass radially through the rod. Alternatively, grooves could be formed in the rod, and the grooves could receive the edges which define the ear holes 19. The grooves would then prevent axial movement of the rod 21.

Figure 3:
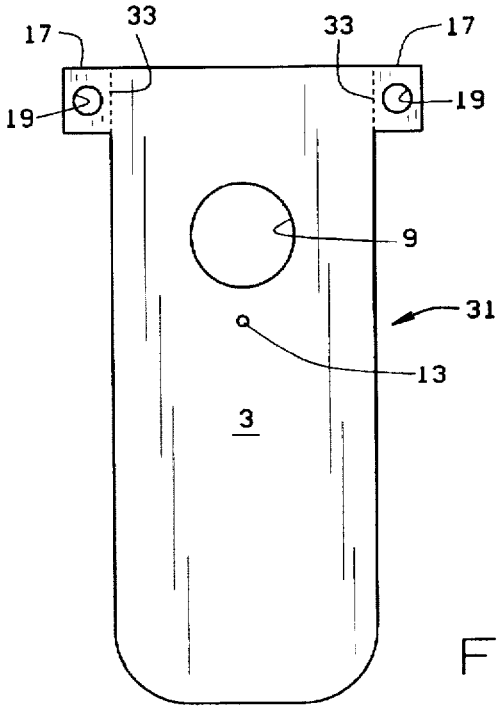
FIG. 3 is a plan view of a blank used to form the ball game.

As seen in FIG. 3, the board 3 and ears 17 are preferably formed from a single blank 31. Thus, the ears 17 are integral with the board 3 and the board with the ears may be formed in a single step, for example by stamping, molding, or vacuum forming the part. A living hinge 33 is formed where the ears 17 extend from the board 3 to allow the ears 17 to be bent rearwardly.

To play the game 1, the user holds the game by the handles 23 and swings the board or kicks the back of the board with his knee to cause the ball to fly into the air. The object then is to bounce the board 3 against the ball 15 with the appropriate force to cause the ball to pass through the opening 9 in the board. The game may be made more or less difficult by varying the size of the opening 9 relative to the size of the ball 15 and by changing the materials of the parts, particularly the ball 15.

As variations within the scope of the appended claims may be apparent to those skilled in the art, the foregoing description is set forth only for illustrative purposes and is not meant to be limiting. For example, ribs may be formed on the back surface 5 of the board 3 to add rigidity to the board. The ears could be replaced with a robe or tubes which are secured to the back surface 5 of the board and through which the rod 21 can be rotatably journaled. Although not preferred, the rod 21 could be adhered to the board 3 and allowed to rotate in the user's hands. These examples are merely illustrative.

I claim:

1. A hand held amusement device including:

a rigid board having a front surface, a back surface, side edges, a top edge, and a bottom edge, a first opening formed spaced from the top edge, a pair of ears extending rearwardly from the side edges of the board at the top thereof, the ears having axially aligned ear holes;

a cord having a fixed end and a free end and being mounted to the board to extend from the front surface of the board, the cord having a length less than a distance between the bottom edge of the board and a point of attachment of the cord to the board;

a ball secured to the free end, the ball and board being made of materials such that the ball will bounce on the board; and a rod rotatably journaled in the ear holes.

2. The amusement device of claim 1 wherein the rod is substantially axially fixed relative to the ears.

3. The amusement device of claim 1 wherein the opening is generally centered between the side edges of the board.

4. The amusement device of claim 3 wherein the cord is attached to the board at a point generally centered between the side edges of the board.

5. The amusement device of claim 4 including a hole formed in the board beneath said opening, said cord passing through said hole, the amusement device including means, adjacent the back surface of the board, for preventing the cord from detaching from the board.

6. The amusement device of claim 5 wherein the means includes a knot formed in the fixed end of the cord, the knot being larger than the hole.

7. The amusement device of claim 1 wherein the ball is hollow.

8. A hand held amusement device including:

a rigid board having a front surface, a back surface, side edges, a top edge, and a bottom edge, a target on the front face spaced from the top edge;

a cord having a fixed end and a free end and being mounted to the board to extend from the front surface of the board, the cord having a length less than a distance between the bottom edge of the board and a point of attachment of the cord to the board;

a projectile secured to the free end of the cord; and a handle extending outwardly beyond both side edges of the board adjacent the top edge of the board, the board and handle being proportioned such that the handle can be held in a user's hands with the board depending from the handle to a position in which the board can be struck with the user's knee to cause the board to strike the projectile and cause the projectile to arc toward the target, the board comprising a pair of ears extending from the side edges of the board at the top thereof, an ear hole being formed in each of the ears, the ears being bent to form axially aligned ear holes, the handle being formed by a rod extending through the ear holes.

9. The device of claim 8 wherein the target comprises at least one hole in the board.

10. The device of claim 8 wherein the projectile is a ball.

11. The device of claim 8 wherein the board is rotatable with respect to the rod when the board is struck with the user's knee and the rod is held by the user.

* * * * *